United States Patent [19]

Krummel

[11] Patent Number: 4,547,706

[45] Date of Patent: Oct. 15, 1985

[54] INVERTER WITH A LOAD CIRCUIT CONTAINING A SERIES OSCILLATING CIRCUIT AND A DISCHARGE LAMP

[75] Inventor: Peter Krummel, St. Georgen, Fed. Rep. of Germany

[73] Assignee: Siemens Aktiengesellschaft, Berlin & Munich, Fed. Rep. of Germany

[21] Appl. No.: 561,675

[22] Filed: Dec. 15, 1983

[30] Foreign Application Priority Data

Dec. 15, 1982 [DE] Fed. Rep. of Germany ..... 3246454

[51] Int. Cl.[4] ..... H05B 37/02

[52] U.S. Cl. ..... 315/226; 315/207; 315/209 R; 315/244; 315/DIG. 7

[58] Field of Search ..... 315/226, 244, DIG. 7, 315/209 R, 241 R, 207

[56] References Cited

U.S. PATENT DOCUMENTS

| | | | |
|---|---|---|---|
| 4,253,043 | 2/1981 | Chermin et al. | 315/245 |
| 4,291,254 | 9/1981 | Arlt | 315/226 |
| 4,406,976 | 9/1983 | Wisbey et al. | 315/244 |

FOREIGN PATENT DOCUMENTS 3112281 10/1982 Fed. Rep. of Germany .

*Primary Examiner*—Harold Dixon

*Attorney, Agent, or Firm*—Hill, Van Santen, Steadman & Simpson

[57] ABSTRACT

In an inverter controlled with a firing unit connected to switches and defining an operating frequency, a resonant frequency of a series oscillating circuit of the inverter connected to one of the switches is placed below this operating frequency. Given this operating situation, a short of the d.c. voltage source is impossible. Given, for example, unfavorable component tolerances, however, the operating frequency can be moved close to the resonant frequency and cause impermissibly high voltages at the components. Such a voltage rise is limited according to the invention by means of a voltage-dependent resistor. It preferably lies in series with a capacitor and takes care of a voltage-dependent shift of the resonant frequency.

6 Claims, 2 Drawing Figures

INVERTER WITH A LOAD CIRCUIT CONTAINING A SERIES OSCILLATING CIRCUIT AND A DISCHARGE LAMP

BACKGROUND OF THE INVENTION

The invention relates to an inverter having first and second switches connected in series across a DC source. When one of the switches is conducting, the other is open.

Care must be taken given such an inverter known from German OS No. 31 12 281, incorporated herein by reference, that alternately activated electronic switches never, and not even briefly, conduct current at the same time which would result in a short-circuit of the constant voltage source. Observation of this condition is particularly important given employment of semiconductor switches. Given an inverter of the type initially cited, therefore, the operating frequency of the inverter during ignition mode determined for example by a saturation transformer, is therefore placed above a resonant frequency of a series oscillating circuit. The inverter is then inductively loaded and the current through a switch employed in the inverter necessarily becomes zero before the voltage passes through zero and, dependent thereon, another switch employed in the inverter is driven.

A variety of causes, such as the failure of one or more lamps or an unfavorable coincidence of the tolerances of components, can result in the operating frequency of the inverter closely approaching the resonant frequency. Given, in particular, very low loss components of the series oscillating circuit, this consequently leads to correspondingly high voltages which can jeopardize not only the components of the inverter, but also can result in danger to personnel when they work at the lamp sockets.

SUMMARY OF THE INVENTION

It is an object of the invention to avoid impermissible overvoltage. Given an inverter of the type initially cited, according to the invention a voltage-dependent resistor which, either alone or as a part of a voltage divider in series with a further voltage divider element, forms a parallel branch to the choke or to the capacitor of the series oscillating circuit.

When the inverter feeds a plurality of lamps with allocated series oscillating circuits in a parallel mode, then such a parallel branch with a voltage-dependent resistor is allocated to each series oscillating circuit.

The characteristic of a voltage-dependent resistor exhibits a first range in which practically no current flows up to a specific limit voltage. The active range then follows in which the characteristic is as steep as possible. The voltage-dependent resistor blocks practically up to the limit voltage in both directions and has a resistance which is in practice very low for voltages lying thereabove. Given a corresponding matching of the limit voltage of the voltage-dependent resistor to the parameters of the inverter and its load circuit, it can be achieved that the voltage-dependent resistor functions in the current-conducting range during an ignition mode of the lamps. Should an impermissably high voltage attempt to occur at the components of the series oscillating circuit, then the voltage-dependent resistor forms a decay factor or attenuation of the oscillating circuit which results in a voltage rise that is correspondingly significantly lower.

Furthermore, the voltage-dependent resistor is dimensioned such that it conducts practically no current when the lamp has lit. The series oscillating circuit is damped by the lamp or is completely inactive. The voltage at the components of the load circuit is limited to the lower maintaining voltage of the lamp.

Fundamentally, the voltage-dependent resistor, either alone or in series with a further voltage divider element, can be connected parallel to the capacitor or the choke of the series oscillating circuit. However, it is particularly advantageous to place the voltage-dependent resistor parallel to the choke of the oscillating circuit and the second switch of the inverter. In this case, a signal for the current-dependent shutdown of the inverter can be acquired via the voltage-dependent resistor in a particularly simple fashion.

It is particularly advantageous to employ a series connection comprising a voltage-dependent resistor and a capacitor. When the voltage-dependent resistor, functions in the current-conducting range, i.e. given the ignition mode, the resonant frequency of the series oscillating circuit is thus altered. Given a correspondingly steep characteristic of the voltage-dependent resistor, even a variation of the operating frequency of the inverter in a wide range then only results in a very slight change of the ignition voltage at the lamp. Accordingly, components having high tolerances can be used, and these components only require a correspondingly low electric strength.

DESCRIPTION OF THE PREFERRED EMBODIMENTS

The inverter W is connected over terminals w1, w2 to a dc power source H which is fed by an alternating voltage network N and which supplies a d.c. voltage to the inverter. A very large storage capacitor C6 and a series connection comprising two controllable switches in the form of transistors V1, V2 lies between the terminals w1, w2. The load circuit lies parallel to a close-open path of V1, this load circuit comprising a series connection of a coupling capacitor C1, a discharge lamp E having heatable electrodes e1, e2, an oscillating circuit choke L, and a primary winding t1 of a saturation transformer T. The electrodes e1, e2 of the lamp E are connected in series via an oscillating circuit capacitor C, this oscillating circuit capacitor C and the oscillating circuit choke L defining a resonant frequency $f_0$.

The two transistors V1, V2 are alternately driven by a firing unit S. The firing unit contains secondary windings t2, t3 of the saturation transformer T from which the control voltages for the transistors are derived. Here, the operating frequency $f_B$ of the inverter is defined by the parameters of the saturation transformer T in relationship to the parameters of the inverter and its load circuit. This operating frequency must always lie above the resonant frequency of the load circuit so that a current-free phase is assured between the inhibiting mode of the one transistor and the driving mode of the other.

In series with a capacitor C4, the voltage-dependent resistor R1 forms a parallel branch that lies parallel to the series connection formed of the choke L, saturation transformer T, and the second transistor V2 of the inverter. Given a conductive switch V2, C4 is thus charged from the storage capacitor C6 over C and C1 and its charge is reversed on the same path given a conductive V1 as soon as the limit voltage of R1 is crossed.

The monitoring means for the current-dependent shutdown of the inverter is connected to the capacitor C4. A thyristor V3 serves for disconnect, this thyristor V3 being connected to d.c. voltage via the electrode e1. A further secondary winding t4 of the saturation transformer T is connected parallel to the thyristor via a diode D3. The control portion of this thyristor is applied via a switching diode D2 to an RC element R3, C5 which is connected parallel to the capacitor C4 via a resistor R2 and a diode D1. When the voltage at C5 thus reaches a limiting value defined by D2, the thyristor V3 becomes conductive and shorts the winding t4 so that the transistors of the inverter no longer receive control voltages. At the same time, the ignition capacitor C3 likewise lying parallel to V3 is shorted, its voltage initiating the start of the inverter via a switch diode D4. This condition is maintained until the interruption of the holding circuit of the thyristor due to replacement of the lamp E.

Figure 1:
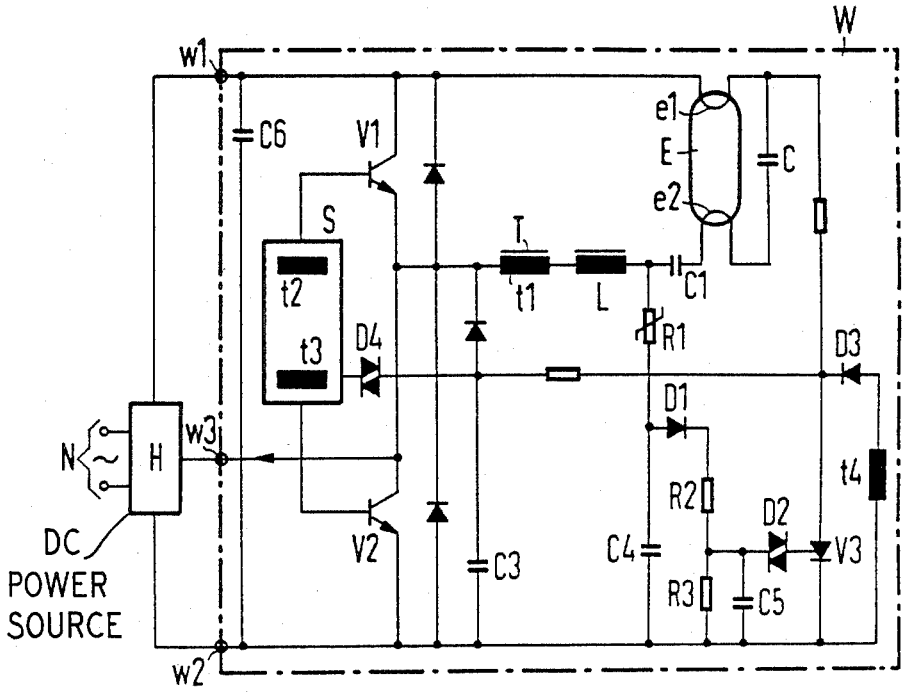
FIG. 1 is a schematic diagram of a preferred embodiment of the invention.
Figure 2:
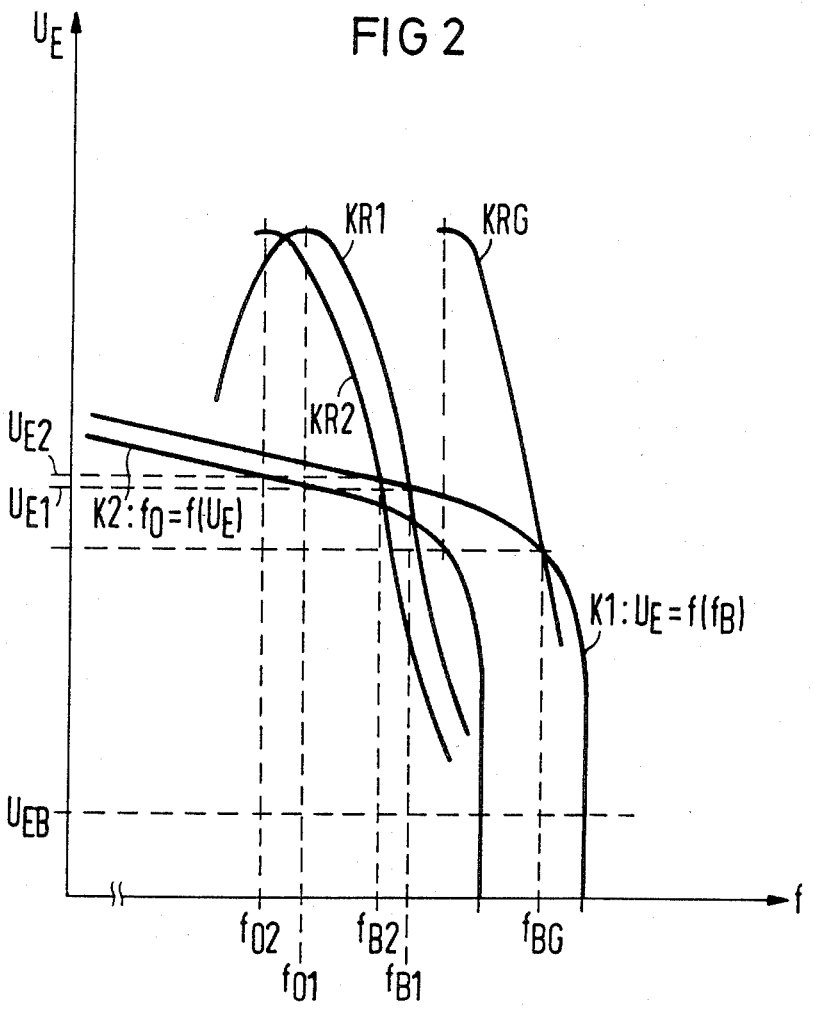
FIG. 2 is a graph showing a dependency between frequency and voltage at a discharge lamp used in the circuit shown in FIG. 1.

Reference is made to FIG. 2 in order to explain the function of the voltage-dependent resistor and of the capacitor C4. The voltage of the discharge lamp $U_E$ which is also the voltage at the capacitor C of the series oscillating circuit is provided on the ordinate. The frequency f is shown on the abscissa.

First, KR1 indicates the voltage curve at the lamp or at the capacitor C given the ignition mode when all components have the calculated values. The inverter thus functions with an operating frequency $f_{B1}$ to which a lamp voltage $U_{E1}$ is associated. Let the resonant frequency be $f_{01}$ (given oscillating circuits with losses, however, the resonant frequency lies somewhat to the right of the illustrated value and not at the maximum of the voltage at the capacitor). As a consequence of the effect of R1 and C4, however, this resonant frequency is a function of the lamp voltage $U_E$, as shown by the curve K2 in FIG. 2. The curve K1 shifted toward the right parallel thereto is derived therefrom, showing the dependency of the voltage $U_E$ on the operating frequency $f_B$.

If the lower operating frequency $f_{B2}$ were set, for example, instead of the operating frequency $f_{B1}$ (which would result in a correspondingly high lamp voltage without the invention), then the lamp voltage rises only slightly along the curve K1 to the value $U_{E2}$ because the resonant frequency sinks along the curve K2 to the value $f_{02}$ and curve KR2 is thus determining the voltage $U_E$.

A shift of the operating frequency in the opposite direction is allowable up to the limiting value $f_{BG}$ with the corresponding curve KRG. The component parameters are chosen such that the highest operating frequency to be taken into consideration does not exceed this limiting value so that an operating point in the current-conducting range of the characteristic of the voltage-dependent resistor R1 is assured.

After the lamp has been ignited, its maintaining voltage $U_{EB}$ is practically constant. In normal operation of the inverter given a lit lamp, the voltage-dependent resistor R1 is practically idle and causes no losses.

Although various minor changes and modifications might be proposed by those skilled in the art, it will be understood that I wish to include within the claims of the patent warranted hereon all such changes and modifications as reasonably come within my contribution to the art.

I claim as my invention:

1. An inverter, comprising: alternately conductive, controllable first and second switches; a load circuit connected parallel to the first switch; the first and second switches being connected in series across a dc voltage source; the load circuit comprising a series connection of an oscillating circuit choke, a coupling capacitor, and a parallel connection of a discharge lamp and an oscillating circuit capacitor, the discharge lamp having first and second heatable electrodes to which the oscillating circuit capacitor is connected; a firing unit means for alternately opening and closing the first and second switches; the oscillating circuit choke and oscillating circuit capacitor forming an oscillating circuit having a given resonant frequency when the discharge lamp is not ignited, said resonant frequency lying below an operating frequency of the inverter defined by the firing unit; a voltage-dependent resistor being provided in series with a capacitor to form a branch connected to said oscillating circuit, said branch being connected at a point in said oscillating circuit so as to change said given resonant frequency of said oscillating circuit when a voltage present across the voltage-dependent resistor rises and the voltage-dependent resistor enters its active conducting region.

2. An inverter according to claim 1 wherein the branch comprising the voltage-dependent resistor and the capacitor is connected parallel to a series connection comprising the oscillating circuit choke and the second switch of the inverter.

3. An inverter according to claim 2 further comprising a monitoring means for disconnecting the inverter depending upon a current, the voltage at the capacitor connected to the voltage-dependent resistor controlling the monitoring means.

4. An inverter according to claim 1 wherein the voltage-dependent resistor has its characteristics chosen such that an operating point of the voltage-dependent resistor always lies in a current-conducting range during ignition mode of the discharge lamp—and lies in an idle range of the characteristic only given an ignition of the discharge lamp.

5. An inverter according to claim 1 wherein the firing unit means includes a saturation transformer, control voltages for the switches being derived from secondary windings of said saturation transformer, the primary winding lying in the load circuit.

6. An inverter, comprising:

alternately conductive, controllable first and second switches;

a load circuit connected parallel to the first switch;

the first and second switches being connected in series across a dc voltage source;

the load circuit comprising a series connection of an oscillating circuit choke, a coupling capacitor, and a parallel connection of a discharge lamp and an oscillating circuit capacitor, the discharge lamp having first and second heatable electrodes to which the oscillating circuit capacitor is connected;

a firing unit means for alternately opening and closing the first and second switches;

the oscillating circuit choke and oscillating circuit capacitor forming an oscillating circuit having a given resonant frequency when the discharge lamp is not ignited, said resonant frequency lying below an operating frequency of the inverter defined by the firing unit;

a voltage-dependent resistor being provided in series with a capacitor to form a branch which connects to one of the components oscillating circuit choke or oscillating circuit capacitor of said oscillating circuit such that when a voltage present across the voltage-dependent resistor rises and the voltage-dependent resistor enters its active conducting region, the capacitor causes a change of resonance of the oscillating circuit.

* * * * *